United States Patent [19]

Hammer, Jr. et al.

[11] 4,272,111

[45] Jun. 9, 1981

[54] SAFETY LATCH DEVICE

[75] Inventors: Victor S. Hammer, Jr., Lake Zurich; Arthur J. Danko, Oak Lawn; Perry J. Heard, Chicago, all of Ill.

[73] Assignee: Illinois Tool Works Inc., Chicago, Ill.

[21] Appl. No.: 23,819

[22] Filed: Mar. 26, 1979

[51] Int. Cl.[3] ..... E05C 19/06

[52] U.S. Cl. ..... 292/17; 292/DIG. 66; 292/DIG. 69

[58] Field of Search ..... 292/76, 77, 17, 18, 292/19, DIG. 66, DIG. 69

[56] References Cited

U.S. PATENT DOCUMENTS

| | | | |
|---|---|---|---|
| 2,526,539 | 10/1950 | Carroll | 292/17 |
| 2,712,465 | 7/1955 | Tinnerman | 292/340 |
| 2,833,583 | 5/1958 | Stone et al. | 292/340 |
| 2,942,905 | 6/1960 | Wootton | 292/17 |
| 2,993,718 | 7/1961 | Ahlgren | 292/340 |
| 3,038,747 | 6/1962 | Rapota | 292/17 |
| 3,241,873 | 3/1966 | Russell et al. | 292/340 |

*Primary Examiner*—Richard E. Moore

*Attorney, Agent, or Firm*—J. R. Halvorsen; T. W. Buckman

[57] ABSTRACT

A safety anchor latch device for a metallic latch strike including a plastic latch and a metallic spring member having positive position retaining means and positive strike gripping means which at normal operating temperatures are inoperative and supported by the elements of said plastic latch in space relation to a supporting work structure and the metallic latch strike respectively but which positively engages and retains same when said plastic latch is destroyed by abnormally elevated temperatures.

12 Claims, 5 Drawing Figures

SAFETY LATCH DEVICE

BACKGROUND OF THE INVENTION

This invention relates to a novel safety anchor device for application to an aperture work piece, and more particularly to a novel anchor member or receptacle especially suitable for receiving and releaseably retaining a strike pin of a cabinet latch or the like.

As will be understood, cabinet latch devices frequently include a latch pin which is adapted to be mounted to and project from a cabinet door, and an anchor member or receptacle adapted to be mounted on the frame for receiving the pin. Such devices are also desirably used on the doors and cabinets of home laundry dryers. Latch devices of the type contemplated by the present invention can be found in the United States Patent Office classification class 292 and particularly subclass 17 thereof. And more particularly such a latch device is shown in the patent to G. M. Rapata, U.S. Pat. No. 3,038,747 issued June 12, 1962 and which discloses a plastic latch having the desired lubricity to permit ready engagement and disengagement of the strike pin.

While devices of the type shown in U.S. Pat. No. 3,038,747 operate satisfactorily at normal operating temperatures for dryer devices, it has been found that under extreme temperature conditions, for example when a fire is created in the clothing material being dryed, that the plastic latch devices will not keep the door to the dryer in a closed position. The imposition of more strigent safety rules by various governmental agencies has resulted in a demand for a positive means for maintaining the door to the dryer closed during such abnormal temperature conditions.

SUMMARY OF THE INVENTION

An important object of the present invention is to provide a novel safety anchor device or latch for accomodating a strike element or the like, which anchor member is constructed for receiving and effectively releaseably retaining a strike element during normal operating temperatures and to also positively grip the work structure and the strike, respectively, when the safety anchor device is subjected to abnormally elevated temperatures.

Another object of the present invention is to provide a novel safety anchor latch member which is constructed so that it may be readily applied to an apertured workpiece without the aid of auxiliary fastening means and so that it may repeatably receive and release the strike element under normal operating temperatures without adversely affecting its connection with the apertured workpiece, but, which will under abnormal temperatures positively grip said strike element and maintain the closure or door with which it is associated in locked position which will not inadvertently open. Other objects and advantages of the present invention will become apparent from the following descriptions and the accompanying drawings.

DETAILED DESCRIPTION OF THE DRAWINGS

DETAILED DESCRIPTION OF THE INVENTION

Figure 1:
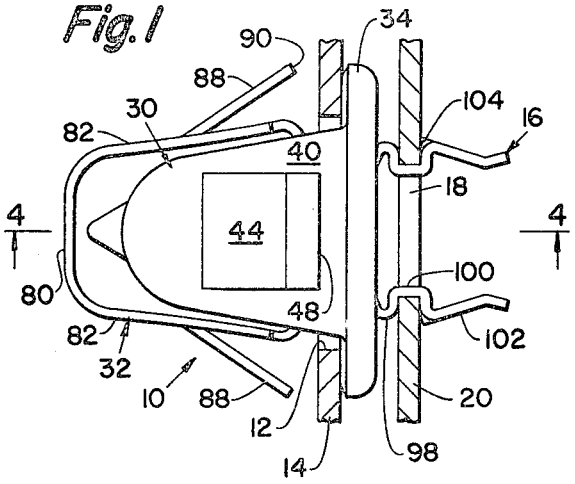
FIG. 1 is an end elevational view in partial section of a preferred embodiment of the present invention.

Referring now more specifically to the drawings wherein like parts are designated by the same numerals throughout the various figures, a safety anchor latch member 10 incorporating a preferred embodiment of the present invention is mounted in aperture 12 of plate 14 while a metallic strike 16 is mounted in aperture 18 of plate 20. It should be noted that plate 14 and plate 20 represent either the door or alternatively the cabinet structure for a dryer or any other apertured work structure which might be subjected to elevated temperatures.

Figure 2:
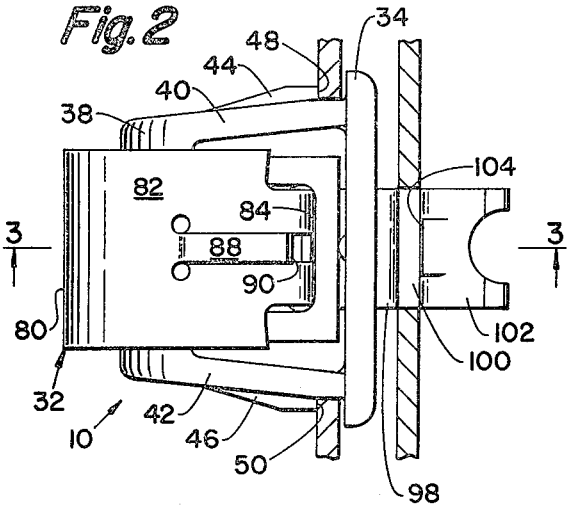
FIG. 2 is a side view of the device shown in FIG. 1 and rotated 90°.
Figure 4:
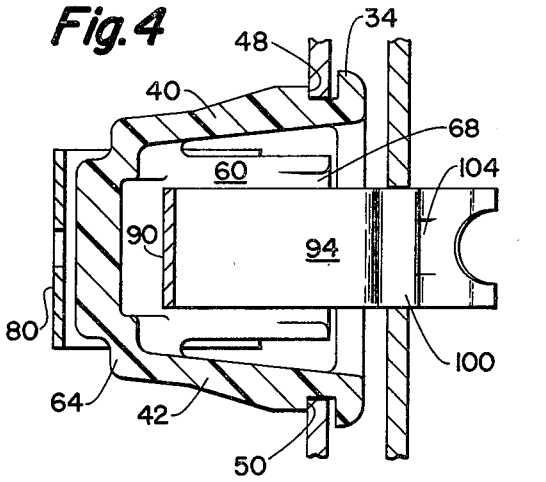
FIG. 4 is a front elevational view in section taken along line 4—4 of FIG. 1.

The safety anchor latch device includes a plastic anchor member 30 and a resilient spring-like sheet metal member 32 which will now be described in more detail. The anchor member 30 is preferably molded in one-piece from a suitable tough resilient plastic material, such as, for example, nylon. The anchor member is provided with a generally radially extending head section 34 engagable with the outer surface of the work piece 14 for preventing the anchor member from passing entirely through the aperture 12. An opening 36 is provided through the head section 34 for permitting the insertion of the strike 16 into the anchor member. The anchor member includes a shank section 38 extending axially from the head section 34 for entry into the work piece 14 in the manner shown. As best seen in FIGS. 2 and 4, the shank portion 38 is provided with a pair of relatively thin and resiliently flexible side portions 40 and 42 which extend from integral junctions with internal marginal portions of the head section 34. The shank side or leg portions 40 and 42 respectively include laterally projecting abutments 44 and 46 which present shoulder surfaces 48 and 50 facing toward the head section 34 for engagement behind the work piece 14. The shoulder surfaces are spaced axially from the head section 34 a distance similar to the thickness of the workpiece 14.

The shank section 30 also includes a pair of oppositely disposed resiliently flexible elements 60 and 62 which extend generally axially with respect to the head section 34 and are adapted to receive and releaseably retain the strike 16 there between. In this embodiment the elements 60 and 62 are operatively interconnected with the head section through an entering end section 64 of the shank which has a generally U-shaped transverse cross-section and which is in turn integrally and operatively interconnected to the head section through the leg portions 40 and 42. It will be noted that the elements 60 and 62 are relatively widely spaced apart at their integral junctions with the entering end section 64 so that they may accomodate the enlarged end of the strike therebetween. It is further to be noted that the element 60 and 62 include inwardly directed abutments or shoulder means 66 and 68 which define a restricted throat therebetween. The width of the throat is substantially less than the transverse dimension of the enlarged end of the strike so that when the strike is entered into the anchor member, the abutment or shoulder element 66 and 68 are forced apart until the enlarged end of the strike is passed whereupon the resilient elements 60 and 62 spring back toward their normal position for causing the abutment 66 and 68 to engage behind and retain the large end of the strike. As shown best in FIG. 3, the surfaces of the abutments 66 and 68 are curved and flaired outwardly in both directions from midpoint to the abutments so as to provide cam surfaces for facilitating spreading of the abutments to permit entry of the strike therebetween and the intentional withdrawal of the strike. It is to be noted that the free ends of the elements 60 and 62 and the strike engageable abutments thereon are located substantially at the head section 34 so that the strike element 16 need be of minimum length to accomplish proper engagement with the abutments. Additionally, the resilient elements 60 and 62 are provided with a groove means 70 and 72 respectively, which terminate in pockets 74 and 76, respectively. The entering end or nose portion 64 includes a tapered projection 78 that blends into the base of the grooves 70 and 72 for purposes best set forth hereinafter.

Figure 3:
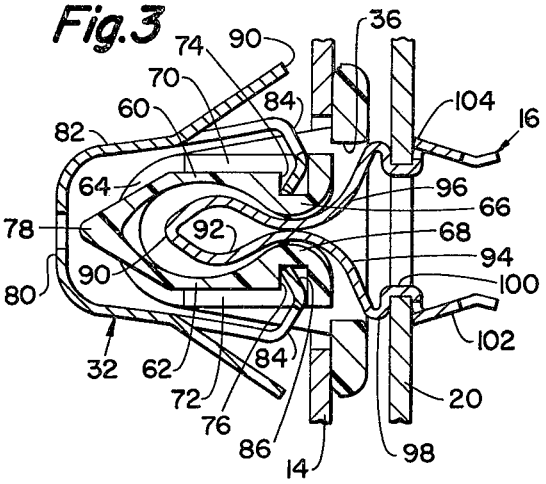
FIG. 3 is an end elevational view in section taken along line 3—3 of FIG. 2.

The safety spring member 32 is generally U-shaped in configuration and includes a base 80 and a pair of arms 82 extending upwardly therefrom. At the extremity of each of the arms 82 is a reduced width portion 84 bent inwardly substantially normal to the arms 82 and the free extremity thereof 86 being reversely bent towards the base 80, as best seen in FIG. 3. The portions 86 provide an abrupt shoulder means at their free end for purposes set forth hereinafter. Extending outwardly from each of the arms 82 are a pair of sheared leg members 88 which are resilient members that provide a shoulder means 90 facing towards the mounting plate 14. In assembly of the spring to the anchor member the reversely bent portions 86 are fed across the tapered nose 78 into the grooves 70 and 72 until these reversely bent portions 86 come to rest in the pockets 74 and 76 whereby the spring member is captured relative to the anchor member. It will be appreciated that while a single resilient leg 88 is shown there can be provided a plurality of such legs either centrally disposed as shown in this embodiment or provided along opposite marginal edges of the spring member 32. The spring member 32 and its initially formed condition is approximately that shown in FIG. 5 but is spread apart when it is associated with the anchor member 30 and provides an added spring characteristic to the flexible retaining members 60 and 62. The primary function of spring member 32 in the present invention will be described hereinafter.

Figure 5:
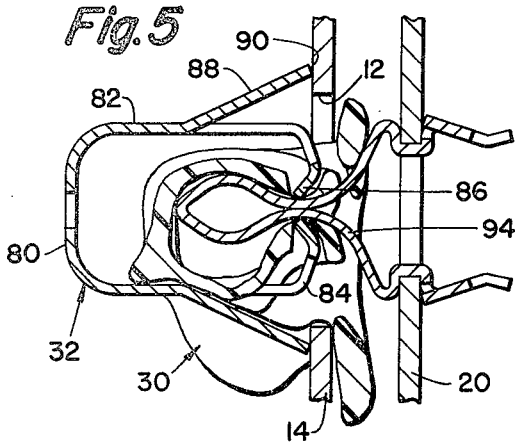
FIG. 5 is an end elevational view in section showing the operation of the safety feature of the present invention when the plastic elements of the latch have been destroyed by elevated temperature.

Referring now to the strike pin 16 shown in this embodiment, there is provided a novel one-piece sheet metal strike pin which can be best seen in FIGS. 3 and 5. This one-piece metallic latch strike is formed from a single strip of resilient material having a substantially uniform width and includes a symmetrical configuration about its axis. The strip of sheet metal is bent in its middle to form a pointed nose portion 90 with each side thereof accutely disposed relative to the axis of the strike. A generally irregular S-shaped portion forming a bulbous nose portion 92 and a necked in portion 94 blending into an enlarged curvilinear portion 96 that is joined to a reversely bent segment 98 forming the base adapted to be seated on one surface of the apertured support structure 20. A generally axially disposed segment 100 occupies the aperture 18 in support structure 20 and blends into the tapered stud or leg portion 102 from which there is sheared appropriate shoulder means 104 for engagement with the opposite surface of supporting panel 20. The one-piece metallic latch strike can be formed from heat treated carbon steel or from C-1050 steel and preferably is suitably coated to prevent corrosion due to the high humidity environment it is to be used in a clothes dryer.

It will be noted in FIGS. 1 and 3, particularly, that the pockets 74 and 76 at the ends of grooves 70 and 72 form a reduced section for the protruberance catch portion 66 and 68 of the anchor member 30. While the spring 32 does supply supplementary spring action to these elements of the anchor member 30 the spring per se does not contact the strike, but rather, the lubricious surfaces of the anchor member being made of a suitable plastic will readily glide over the pointed nose 90, the bulbous portion 92 into the concavity of the necked-down portion 94 of the metallic latch strike 16. Similarly the shoulders 90 of the legs 88 are used in spaced relation to the panel 14 under normal operating conditions. However when the entire assembly is subjected to abnormally high temperatures, for example, in the event a fire breaks out in the clothes dryer, and the plastic anchor member 30 is destroyed as schematically shown in FIG. 5, the design of the present invention permits the safety spring member 32 to have the shoulders formed on the inwardly directed portion 86 to grip the neck down portion 94 of the metallic strike in a very aggressive manner because of the reverse disposition of portions 86. Also the shoulders 90 on legs 88 have a larger span than the largest dimension of aperture 12 in panel 14 and therefore prevent withdrawal of the safety spring member 32 through panel 14 aperture 12. In this fashion the closure to the clothes dryer is prevented from opening and spreading the conflagration to the surrounding environment. It will be appreciated that by thinning the plastic material, for example by use of the retaining pocket 74 and 76 for the reversely bent shoulder means 86 that introduction of a high temperature that would cause a melting of the plastic forming the anchor member 30 will cause an immediate gripping of metal to metal against the strike pin and the shoulder portions 86. This therefore insures the high degree of safety factor now required by certain governmental agencies for this type of fastener to be used in the environment of a clothes dryer or any other environment requiring safety against unexpected exposure to elevated temperatures.

I claim:

1. A safety anchor latch device for accepting a metallic latch strike adapted for use in a supporting structure such as an apertured metallic cabinet and closure therefore with said latch being designed for use at a predetermined maximum operating temperature, including a self retained plastic latch, said latch fabricated of a plastic material having the characteristic of melting at a predetermined temperature, a metallic resilient spring member having positive position retaining means and positive strike gripping means which at normal operating temperatures are inoperative and supported by elements of said plastic latch in spaced relation to said supporting structure and the metallic latch strike respectively but which positively engage and retain same when the structural integrity of said plastic latch is destroyed by abnormally elevated temperatures in excess of said predetermined temperature, whereby said supporting structure is maintained in a closed position and migration because of the elevated temperature is prevented.

2. A safety anchor device for a metallic latch strike and the like including a plastic head section for overlying one side of an apertured work structure and having an opening therein through which a metallic latch strike and the like may be inserted, a pair of resilient plastic shank sections respectively integral with and extending generally axially from a first pair of opposite inner marginal portions of said head section for entry into the work piece aperture, laterally outwardly projecting plastic shoulder means on said shank sections for engaging behind the work structure when the shank sections are inserted into the aperture for preventing removal of the anchor device from the work structure during normal operating temperatures for which the part was designed, and a pair of opposed resilient plastic elements integrally operably interconnected with said head section and generally axially disposed with respect to said head section and located between and operable independently of said pair of shank sections, said opposed resilient plastic elements being located so as to be substantially bisected by and resiliently shiftable in a direction parallel to a plane containing a central longitudinal axis of said device and intersecting a second pair of opposite inner marginal portions of said head section, said opposed plastic elements including opposed shoulder means projecting toward each other substantially adjacent said head section and defining a throat therebetween substantially bisected by a second plane perpendicular to said first mentioned plane for cooperatively engaging, passing and releasably retaining the enlarged end portion of a metallic latch strike inserted through the opening in the head section during normal operating temperatures for which the plastic part was designed, said plastic part being fabricated of a plastic material having the characteristic that it will distort or melt at a predetermined temperature in excess of said normal operating temperature, and metallic spring means embracing and aggressively gripping said opposed plastic elements for resisting spreading of said elements, said spring means including positive retaining means and positive gripping means which at normal operating temperatures are inoperative and supported by said plastic elements in spaced relation to said work structure and metallic latch strike respectively but which positively engage same when said plastic anchor device is destroyed by elevated temperatures beyond said predetermined temperature.

3. A device of the type claimed in claim 2 wherein said metallic spring means includes a generally U-shaped body embracing said resilient opposed plastic elements which define said throat.

4. A device of the type claimed in claim 3 wherein said U-shaped body includes inwardly directed finger means forming said gripping means.

5. A device of the type claimed in claim 4 wherein said finger means extend from adjacent the free ends of the U-shaped body and are reversely bent to extend angularly toward the bottom of said U-shaped body to form positive abutment means at their free extremeities which thereby positively grip said metallic latch strike when said plastic device loses its efficacy due to being subjected to elevated temperature.

6. A device of the type claimed in claim 3 wherein the side walls of said U-shaped body include resilient legs forming said gripping means which are compressible when inserted in said work aperture but providing positive shoulders at their free ends extending toward said head but normally spaced from said work structure during normal operating temperature usage.

7. A device of the type claimed in claim 5 wherein said resilient opposed plastic elements are axially relieved through a portion of their width on their outer surface and adapted to accept said finger means to facilitate assembly of said metallic spring means to said plastic device.

8. A device of the type claimed in claim 7 wherein said resilient plastic elements each include a pocket adjacent said head at the end of axially disposed grooves forming said axial relief, said pockets adapted to accept and capture said finger means and provide a relatively thinner barrier wall between said finger means and the metallic latch strike acceptable in said throat whereby subjecting of said device to elevated temperatures provides a relatively quick destruction of said thin barrier wall and rapid gripping of said metallic latch strike by said metallic finger means.

9. A device of the type claimed in claim 6 wherein said legs are struck from within the margins of said side walls and fingers.

10. A one piece metallic latch strike formed from a single strip of resilient material adapted to be mounted in an apertured work structure, said strip in cross section including a pointed nose portion, a necked in curvilinear portion curving outwardly to a base portion, and an integral shouldered stud portion for cooperatively engaging said work structure between said base portion and said stud portion, said strike being symmetrical about its axis and each side in cross section commencing with the interconnected nose portion includes a first portion acute angularly disposed relative to the axis, said first portion being a part of and blending into an irregular S-shaped second portion with the part of the S-shaped second portion remote from said first portion having a substantially greater radius of curvature than the part joined to said first portion, said remote part being concave outwardly away from said axis, a sharply reversely bent third portion extending inwardly toward said axis to form said base portion, a generally axially disposed fourth portion adapted to be disposed within said aperture and a fifth portion forming shoulder means for said stud portion.

11. A strike of the type claimed in claim 10 wherein said fifth portion includes two reversely bent sections to form shoulder means.

12. A strike of the type claimed in claim 11 wherein said fifth portion includes a resilient spring arm struck from said portion to form an abrupt shoulder facing said base means to capture the strike in the apertured work piece, said remote part of said S-shaped second portion being adapted when its convex surfaces of both sides are brought into intimate contact to provide a rolling action when said fifth portion is introduced into said apertured structure and further said acutely joined nose portion serving as spring means in combination with said touching convex parts to insure aggressive engagement of said base and shoulder portions in mounted relation to said apertured work structure.

* * * * *